United States Patent [19]

Sorenson et al.

[11] 4,329,218

[45] May 11, 1982

[54] VERTICAL CATHODE POCKET ASSEMBLY FOR MEMBRANE-TYPE ELECTROLYTIC CELL

[75] Inventors: Marius W. Sorenson; Bobby R. Ezzell, both of Lake Jackson; John R. Pimlott, Sweeny, all of Tex.

[73] Assignee: The Dow Chemical Company, Midland, Mich.

[21] Appl. No.: 210,941

[22] Filed: Nov. 28, 1980

Related U.S. Application Data

[63] Continuation of Ser. No. 68,133, Aug. 20, 1979, abandoned.

[51] Int. Cl.[3] ..... C25B 11/03; C25B 11/00; C25B 9/00

[52] U.S. Cl. ..... 204/283; 204/286; 204/266

[58] Field of Search ..... 204/283–284, 204/256, 258, 266, 288–289, 278

[56] References Cited

U.S. PATENT DOCUMENTS

| | | | |
|---|---|---|---|
| 3,337,443 | 8/1967 | Raetzsch et al. | 204/256 |
| 3,498,903 | 3/1970 | Kamarjan | 204/266 |
| 3,910,827 | 10/1975 | Raetzsch et al. | 204/98 |
| 3,930,151 | 12/1975 | Shibata et al. | 204/258 |
| 3,963,595 | 6/1976 | Danna | 204/258 |
| 3,963,596 | 6/1976 | Kircher | 204/258 |
| 4,078,987 | 3/1978 | Specht | 204/266 |
| 4,101,410 | 7/1978 | Kircher et al. | 204/282 |
| 4,110,191 | 8/1978 | Specht et al. | 204/266 |
| 4,115,237 | 9/1978 | Woodard, Jr. et al. | 204/258 |
| 4,165,272 | 8/1979 | Cunningham | 204/282 |
| 4,175,024 | 11/1979 | Darlington | 204/252 |
| 4,209,380 | 6/1980 | Raetzsch et al. | 204/282 |
| 4,222,831 | 9/1980 | Specht et al. | 204/278 X |
| 4,248,689 | 2/1981 | Cunningham et al. | 204/283 X |

*Primary Examiner*—Delbert E. Gantz
*Assistant Examiner*—Donald R. Valentine
*Attorney, Agent, or Firm*—M. W. Barrow

[57] ABSTRACT

A pocket shaped cathode for use in an electrolytic cell employing membrane separators between the catholyte and anolyte is described which by reason of its configuration reduces the power requirements of an electrolytic cell. More particularly there is described a cathode which is pocket shaped, has internal gas directing baffles and fluid passageways through one end wall cooperatively associated with the interior of said pocket and the catholyte chamber of an electrolytic cell to circulate fluid to and from said pocket and said chamber and rapidly remove gases generated within and between said pocket baffles. The particular configuration of the present invention gives improvements of up to 7 or more percent in lowered cell voltages, reduces cathode blinding with hydrogen gases, and improves circulation of catholyte to and from the electrolytic process.

12 Claims, 8 Drawing Figures

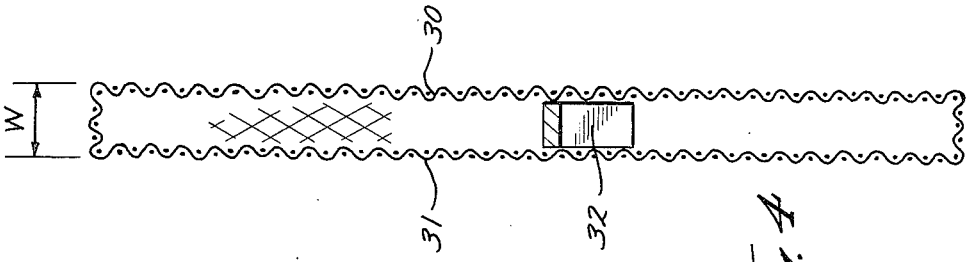
Fig. 4
Fig. 3
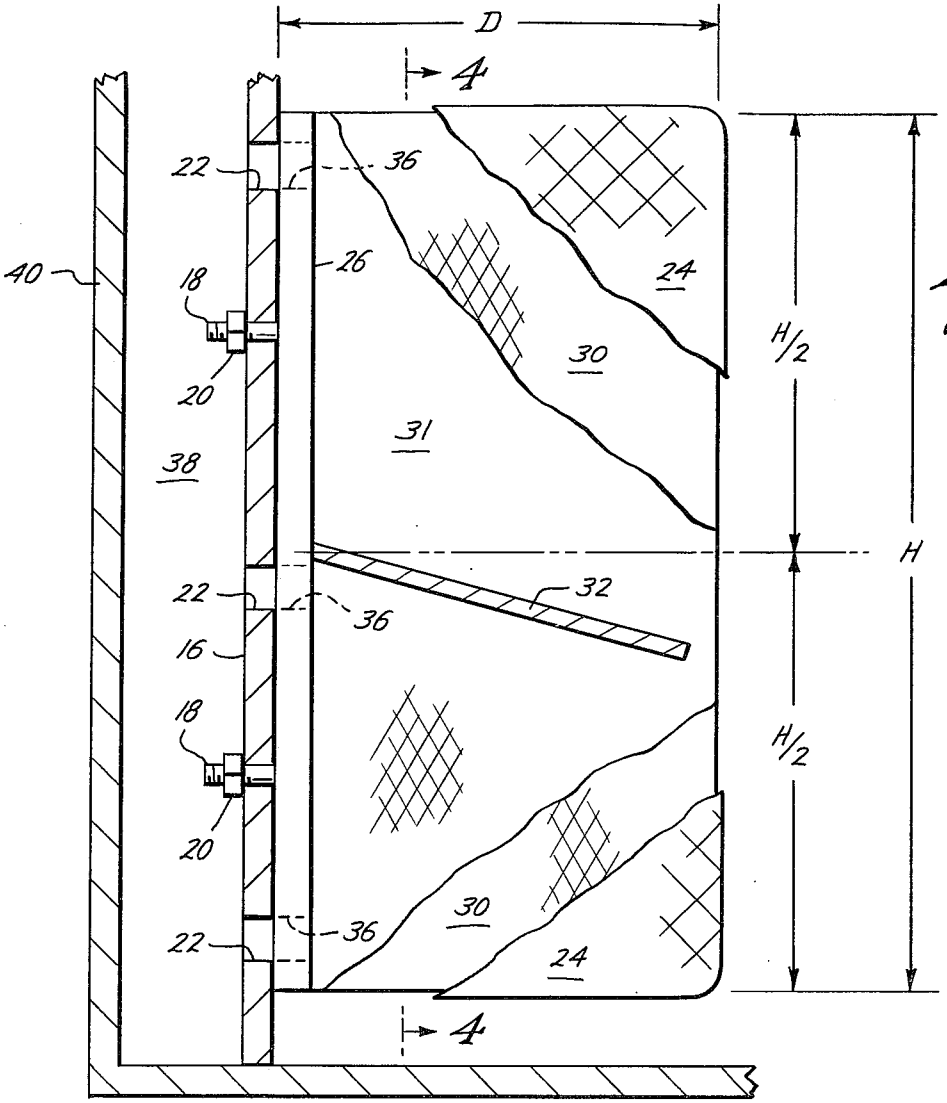

VERTICAL CATHODE POCKET ASSEMBLY FOR MEMBRANE-TYPE ELECTROLYTIC CELL

This is a continuation of application Ser. No. 068,133, filed Aug. 20, 1979, now abandoned.

BACKGROUND OF THE INVENTION

This invention relates to commercial chlor-alkali cells which produce chlorine gas, hydrogen gas, and aqueous sodium hydroxide by the electrolysis of aqueous sodium chloride. More particularly this invention relates to a cathode assembly which can be used with low electrical power (or voltage) requirements in a vertical, finger (or pocket) interleaved anode and cathode electrolytics cells which utilize ion exchange membranes to separate the anodes and cathodes.

Many advances have been made in recent years in the improvement of chlor-alkali production cells. For example, cell voltages have been reduced and cell life prolonged by the replacement of graphite blade anodes with ruthenium oxide coated titanium in the highly corrosive anolyte chambers of these cells. Also higher purity of the aqueous sodium hydroxide has been made possible by the replacement of asbestos type diaphragms with the ion-exchange membranes such as Nafion®. Many other improvements have been made as time has passed, but obviously the tremendous capital costs tied up in existing chlor-alkali plants can not be discarded each time an advance is made. Hence, these improvements have, for the most part, been incorporated into existing cells by adjusting the improvements to fit the existing facilities rather than abandoning existing plants and redesigning and building totally new plants each time an improvement is made. Thus, many inventions have been made by discovering ways to modify new discoveries to work with existing technology. An example of this type of invention is found in Loftfield, U.S. Pat. No. 3,591,483 (July 6, 1971), wherein metal anodes were made with extra width so as to be as wide as the graphite blades they were to replace without wasting excess metal, and thus avoid extensive redesigning of the cells in use.

In the chlor-alkali cell field there are types of diaphragm cells wherein the cathode is commonly referred to as a vertical pocket or a vertical finger. In these cells the cathode is made of a pair of vertical, foraminous, metal members which are connected together in spaced apart relation at their top, bottom, and leading edge to form a hollow interior, or "pocket". This assemblage is attached at its open vertical back edges to a vertical backscreen (or backplate) which has openings therethrough to allow cathodic products to escape out the back of the cathode pocket as opposed to escaping through the top of the pocket. This type of cathode design is what is meant by "vertical" cathode pockets in this specification. Examples of such vertical cathode pockets can be found in several patents, e.g., Cunningham et al, U.S. Pat. No. 4,016,064 (Apr. 5, 1977), Hunter, et al., U.S. Pat. No. 2,282,058 (Jan. 24, 1939).

With the advent of ion-exchange membranes to replace the diaphram in existing vertical type cells it has been discovered that modification can be made in the vertical cathode to enable the cells to operate at higher power efficiencies through reduced cell voltage.

This and other benefits and advantages have been achieved in the present invention as will become apparent in the following description and examples.

SUMMARY OF THE INVENTION

In accordance with the present invention it has been discovered that a vertical, pocket type membrane electrolytic cell can be operated at efficiencies comparable to the best operating flat plate membrane cells by substituting for the conventional diaphragm covered cathode a membrane covered vertical cathode pocket having a vertical backplate with openings, communicating with the catholyte chamber, the sum of the area of said holes being greater than about 5% of the backplate abutting area of the cathode pocket, at least one internal baffle extending from said backplate abutting side of said cathode and sloping downwardly from the horizontal at between about 5° to about 60° and extending into said pocket from about 60% to about 98% of the depth of said pocket, said baffles located above at least one opening in said backplate side of said cathode pocket, said baffles and said openings cooperating to improve the circulation of catholyte in said pocket to decrease the amount of hydrogen in said pocket interior, and to reduce gas blinding at the interior membrane surfaces. While most of the afore-stated advantages are difficult or impossible to measure directly, reduced cell operational voltage for equal production of products in such cells is attributed to one or more of these stated parameters. It is contemplated that the cathode of the present invention will have a width of from about one-half to about one and one-half inches, but it may be advantageous to substitute a wider cathode since, as the data below will establish, the greater the internal spacing between internal faces of the cathode, the lower will be the voltage up to a width of at least about one and one-half inches.

More particularly it has now been discovered that said advantages such as unexpectedly low chlor-alkali (or chlorine) cell operating voltages can be obtained by a vertical cathode pocket assembly which comprises:

two parallel, vertical, foraminous, spaced apart metal members which have their top, bottom and leading edges joined together to maintain the spaced apart relationship with a vertical backbar provided with portholes to form a pocket;

interior of the pocket and extending from and attached to the backbar is located at least one baffle which slopes downward from the vertical into the cathode pocket between parallel members at an angle of from about 5° to about 60° from the horizontal, and which baffles extend into the pocket a distance of from about 60% to about 98% of the pocket depth and are spaced substantially equidistant along the backbar at intervals which are no greater than from about 2 feet to about 3 feet;

the vertical backbar being provided with a number of openings, one being located at the top of the backbar, one at the bottom, and one directly beneath each site place on the backbar to which the baffle is attached, the area of each opening being substantially equal to the area of each of the other openings, and the sum of the areas of all of the openings being greater than about 5% of the area of a vertical cross-section of the cathode pocket at the backbar; and a membrane envelope fitted around the cathode assembly and sealably attached there around with the backbar.

There is thus formed an assemblage which can be electrically connected to the cathode side of the cell and align with the openings in the backplate of the catholyte chamber of the cell in fluid communication therewith.

A preferable cathode of the present invention is one in which a woven steel wire sheet is bent back onto itself to provide a thin U-shaped structure and welding the two sides adjacent the closed end together to maintain the spacing between the parallel woven wires, leaving the fourth side open. There is thus formed a pocket-like member which is closed by a bar of steel of the dimensions of the opening welded to the wire edges of the opening. The bar, or backbar as it is alternately referred to, has studs secured to it as by welding. These studs serve to secure the cathode pocket in place in the cell in both electrical contact with the cathode backplate of the cell and in liquid tight assembly with the backplate to provide a seal against the catholyte passing from the cathode chamber into the anolyte chamber. The backbar has at least one matingly fluid communicating porthole aligned with similar openings in the backplate of the catholyte chamber of the cell thereby allowing fluid communication with and out of the pocket from and to the cathode to chamber. The cathode most preferably should not exceed one and one-half inches in width and have at least 50% of the backbar open. It is also preferable if the width is not less than about three-quarters inch and the backbar have not less than three portholes equalling not less than about 15% of the backbar area.

BRIEF DESCRIPTION OF THE DRAWINGS

Further features and advantages of the present invention will become more apparent from the following specification taken in connection with the drawings wherein like parts have the same numbers and wherein:

FIG. 3 is a side elevation of the preferred embodiment of the vertical cathode pocket assembly 10 of this invention with the near side working face 30 and the near side ion-exchange membrane 24 shown partially broken away so that the interior of the assembly may be partially viewed, and with the cathode pocket attached to catholyte circulation and degassing compartment 38.

FIG. 4 is a cross-sectional view of the working faces 30, 31 and the baffle 32 taken along line 4—4 in FIG. 3.

DETAILED DESCRIPTION OF THE PREFERRED EMBODIMENT

Figure 1:
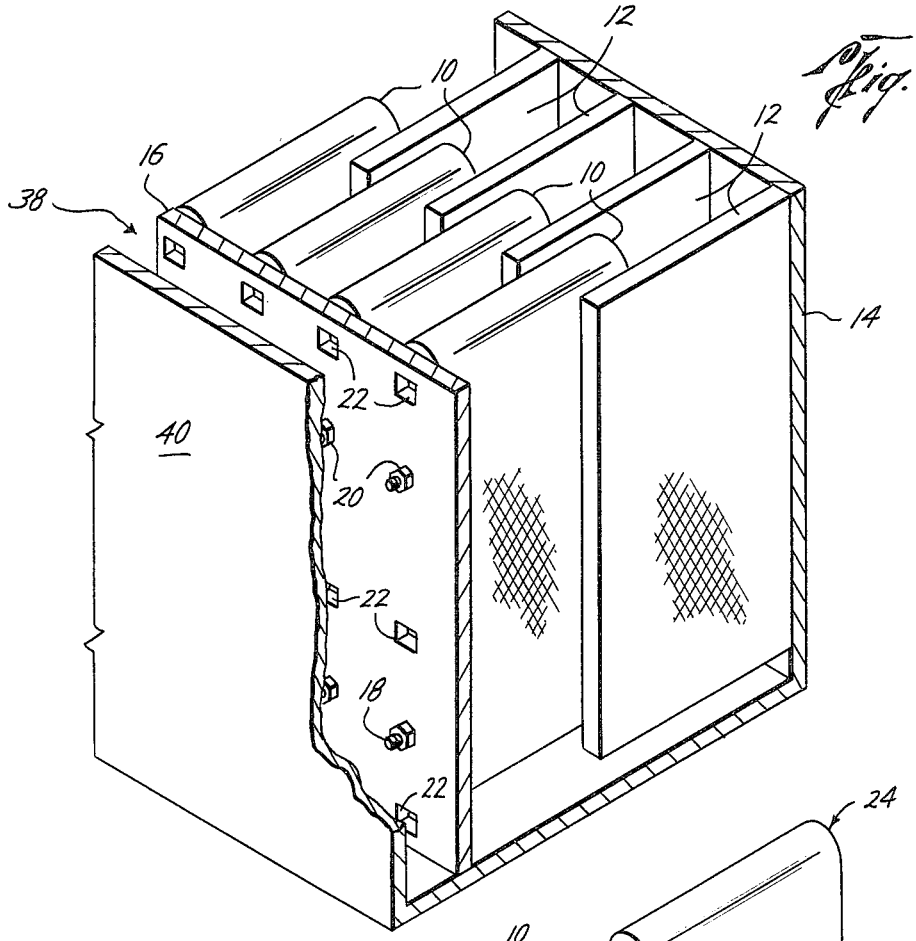
FIG. 1 is an isometric, partial view of a section of a chlor-alkali cell which employs vertical cathode pockets wherein the the vertical cathode pockets 10 are interleaved between anode fingers 12.

With particular reference to FIG. 1, a portion of a cell, for example a chlorine cell in which chlorine gas, sodium hydroxide and hydrogen gas are produced from the electrolysis of brine, is shown in partial cutaway section, illustrating the alternating parallel configuration of the anodes 12 with cathodes 10. Anode 12 is electrically and mechanically connected to backboard 14 while cathode 10 is electrically and mechanically connected to vertical backplate 16. In the final assembly of the cell, anodes 12 extend perpendicularly across the cell from anode backboard 14 nearly to cathode backplate 16. Likewise, cathodes 10 extend perpendicularly between anodes 12 from cathode backplate 16 nearly to anode backboard 14. Of course, direct electrical contact between the anode and cathode components should be avoided else the cell be short-circuited, albeit the discrete gap between the anode working faces and adjacent cathode working faces 30, 31 is desired to be minimal. The anode 12 may be a foraminous plate of electroconductive material, valve metal (Ti, Ta, etc) for example, with its surface coated with electrocatalytic conductive material such as $RuO_2$, $Co_3O_4$, etc. The electrolyic working faces of cathode 10 are made of a foraminous current carrying material such as steel sheet which has been punched, expanded metal steel sheet, woven wire, or wire mesh. This material is joined at the top, bottom and the extended end to form a pocket over which a membrane material has been fastened as by seizing in the bite between the backbar 26 of the cathode and the backplate 16 of the cell catholyte chamber. The cathode and anode are each held in electrical contact with their respective backplate 16 and backboard 14 by bolts 18 and nuts 19 positioned in a manner to matingly engage holes provided in these back supports to receive the same.

It is, of course, to be understood that configurations other than that illustrated may be employed for conducting electrical currents to the anode such as employing the bottom of the cell as the anode backboard conductor. However, the most common configuration is that shown in the drawings.

As previously set forth, numerous holes 22 are provided in the cathode backplate 16 in addition to those required to secure the cathode 10 thereto by studs 18. These additional holes provide communication between the interior of the cathode 10 and the catholyte chamber 38 to facilitate the removal of the product liquid and gases from the cathode pocket 10 where they are produced and to provide renewal of liquid to the cathode interior. It has been found that the operating voltage of a cell is dependent upon the size and location of these communication ports or holes. More particularly as to port size, this voltage is found to be dependent upon the ratio of the sum of the areas of the ports for any given cathode pocket to the total area of that pocket's abutting area to the backplate. Optimum open areas for liquid and gas communication also dictates location of these holes and the number of interior pocket baffles, the location and purpose of which will be explained later. The minimum number of holes and the location are one hole at the top of the cathode, one at the bottom and one below each baffle. The total area of these holes for a given cathode is preferably not less than about 1 square inch per 18 square inches of cathode pocket abutting area. Such openings provide for release of the hydrogen gas from the interior of cathode pocket and for recirculation liquid carried out of pocket 10 through the mating portholes 36, 22 by the gas lifting action of the hydrogen gas produced in pocket 10. This recirculation of the liquid back into cathode 10 after it has entered catholyte chamber 38 will be discussed below. The greater the area of the openings the greater the hydrogen release from the pocket when the hydrogen is channeled to these openings by appropriately spaced baffles. While two or four small holes at the top and bottom are operative, it will be shown in the examples that the greater the open area and the larger number of baffles within the baffle location parameter result in the greatest decrease in voltage indicating the greatest release of formed hydrogen from the pocket. Further the greater the opening area and the more baffles within the parameter apparently contribute better circulation of the liquid and result in lower voltages as a general rule. However, there is also an upper limit to the application of this rule beyond which undesired voltage increases start to occur. This upper limit will be demonstrated in the examples below. Suffice it for now to say it relates to the total open area of the holes 22, 36 for a given current density.

Figure 2:
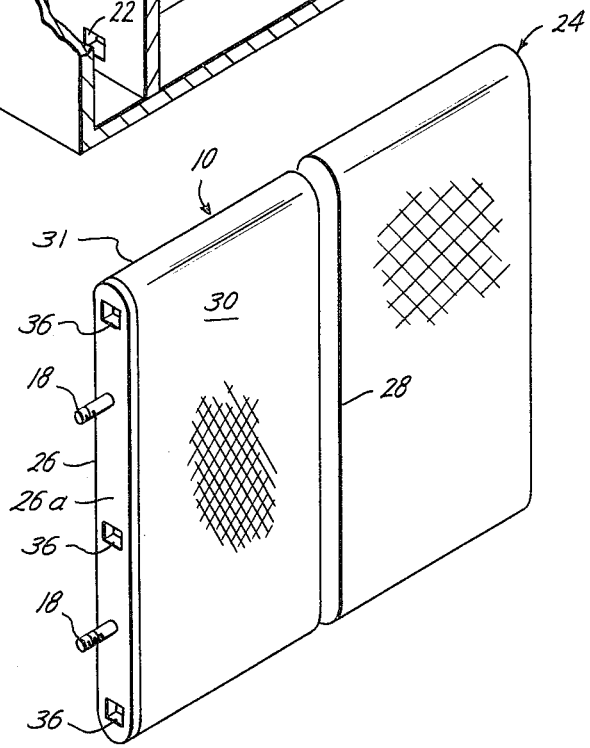
FIG. 2 is an isometric, exploded view of the preferred vertical cathode pocket assembly of this invention.

In FIG. 2 the preferred method of disposing ion exchange membranes 24 within the cell is shown in an exploded view. Essentially, membrane 24 has the shape of an envelope or sock which loosely fits around cathode pocket 10 with the exception that it does not fit so far around backbar 26 as to interfere with catholyte flow through porthole 36. Before pocket 10 is installed in a chlor-alkali cell, membrane sock 24 is slipped over cathode 10 with the back edges 28 of membrane 24 being curved around backbar 26 sufficiently to allow these edges to be affixed, as by glueing, to the backside (the stud side) of backbar 26. Referring also to FIG. 3 and FIG. 1, it can be seen that when cathode pocket 10 is snugged up rigidly and sealable against cathode backplate 16 with studs 18 and nuts 20, membrane envelope 24 completely encloses cathode pocket 10 insofar as that part of the pocket which is in contact with any anolyte around the anodes 12 is concerned. In the preferred mode, a gasket surface such as rubber is interposed between backbar 26 and backplate 16. This gasket has appropriate holes cut in it corresponding to those in backbar 26 and backplate 16. For clarity in the drawings this gasket is not shown.

Suitable materials for ion exchange membranes are known in the art such as E. I. duPonts' Nafion ®. Other membrane materials include the carboxylate polyfluorinated derivatives of polymers of similar structure as the Nafion ® while still others are in the development state but will have similar characteristics.

Referring now to FIG. 3 and FIG. 4 for a more detailed description of cathode 10 it is seen that cathode pocket 10 is comprised of two preferably parallel, vertical, foraminous working faces 30 and 31 at least one baffle 32, and cathode backbar 26. However it is to be clearly understood that it is not necessary that the faces be parallel. They could be formed as a wedge where the width is greater at the backplate end.

Working faces 30 and 31 are shown as parallel to one another although it should be understood that these faces could be angled so as to form a wedge and spaced apart from one another a distance of at least an average of about 0.75 inches (1.905 cm). Preferably they are spaced apart at least about 1.0 inch (2.54 cm), more preferably at least about 1.5 inches, and most preferably about 1.5 inches (3.81 cm) average width if not parallel. The spacing of the working faces dramatically affects the cell operational voltage. This effect will be clearly demonstrated in Examples 1–5 below. Suffice it now to state that speaking generally, it has been discovered that cell voltage decreases as working faces 30, 31 are spread further apart. and for a given current density, increased working face spacing past a particular width produces little advantage in decreased cell operating voltage. For example, with a current density of about 1.0 amp/in.$^2$ (15.5 amperes/dm$^2$) voltage decreases become insignificant when the working faces are spaced apart more than about 1.5 inches (3.81 cm).

The working faces 30 and 31 of cathode pocket 10 are connected together at their top, bottom and leading edges. For purposes of this specification the "leading edges" of the working faces are defined as the vertical edges of the working faces furtherest away from backbar 26. Also the "back edges" of working faces 30, 31 are defined as those vertical edges which are located nearest backbar 26, i.e. those that are attached to backbar 26.

In the preferred embodiment, faces 30, 31 are formed from a single sheet of woven wire. This woven wire is bent in a "U" or "C" shape with its ends forming the back edges. Thus the leading edges are "automatically connected", leaving only the top and bottom edges to be joined. These top and bottom edges are bent inwardly toward each other until they contact their corresponding edge sufficiently enough to be connected by means such as welding. In all embodiments, however, the working faces 30, 31 remain spaced apart after the edges have been connected so as to have a hollow interior for the pocket. Cathode working faces 30, 31 can be made from any electrically conductive foraminous material which does not deteriorate in a highly caustic environment. Examples of such materials are steel, iron, nickel, molybdenum, high surface area (HSA) Ni coated steel, HSA Co coated steel and HSA Mo coated steel. Preferable materials are steel, iron, high surface area (HSA) nickel coated steel, HSA Co coated steel, HSA Mo coated steel or combinations of HSA coats.

The back edges of cathode pocket working faces 30,31 are attached to cathode backbar 26 by means such as welding.

Cathode backbar 26 is a vertical bar having the same width as cathode 10. It is a mechanical and electrical connecting means between cathode working faces 30 and 31 and cathode backplate 16. It is not necessary as an electrical conductor and could be made from nonconducting materials such as plastics for the scope of the present invention. Also it is a structural support for cathode working faces 30, 31. If, however, cathode backbar 26 is electrically non-conductive, then other means must be employed to form an electrical connection between working faces 30, 31 and cathode backplate 16. For example, working faces 30, 31 could be welded directly to backplate 26 or they could be welded to the heads of metal bolts 18 which themselves are in electrical contact with backplate 26.

Portholes 36 are located in backbar 26 to provide better circulation of catholyte, hydrogen, and make-up water out of and into the interior of the hollow cathode pocket 10. Porthole size will be discussed below in conjunction with the examples as it has a definite effect upon operating voltage. In catholyte chamber 38 most of the hydrogen gas formed escapes upwardly and out of the top while most of the liquid catholyte circulates downwardly in catholyte chamber 38 and back into the interior of cathode pocket 10 through backplate portholes 22 and correspondingly aligned backbar portholes 36.

Figure 5:
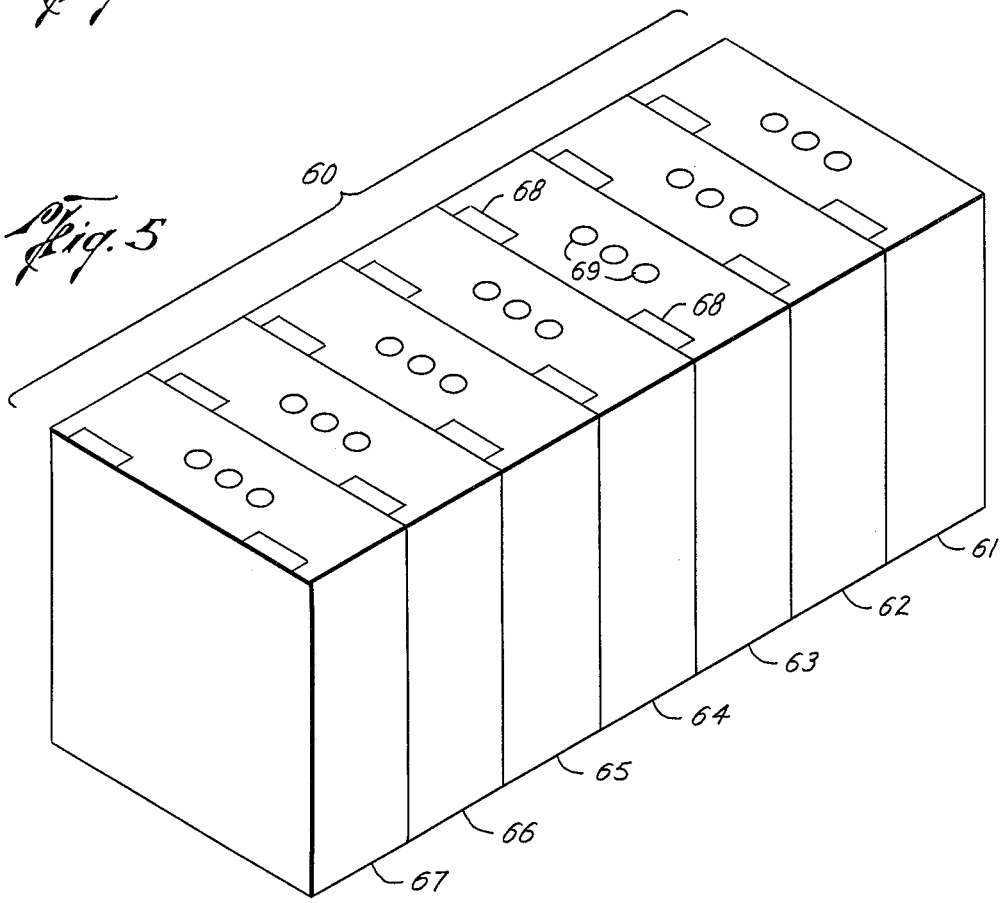
FIG. 5 is an isometric view of a series of cells in which the cell of FIG. 1 is preferably employed.

Catholyte chamber 38 is defined by cathode backplate 16 on one side, a partition 40 (FIG. 3) on the opposite side and a frame 50 which is sealed against the top, bottom and sides of backplate 26. Chamber 38 has outlets for hydrogen and caustic. Only a section of the bottom of frame 50 is seen in FIG. 3. Usually partition 40 is the anode backboard 14 which is recessed in the frame of the next adjacent cell in a cell series such as shown in FIG. 5. FIG. 5 illustrates a multicell installation, commonly referred to as a series cell, in which vertical cathode pockets are used. In these cell series numerous cells can be joined back to back, in FIG. 5 seven cells, 61, 62, 63, 64, 65, 66, 67 are shown. These cells are joined in such a fashion so that when a positive voltage is applied to the anodes of a terminal cell, i.e. cell 61, an electrical circuit is formed through the electrolyte in each cell from anode to cathode to anode to cathode, etc., down the series. Through this series electrical current passes providing the voltage and electrical charges required to perform the desired electrolysis of the aqueous sodium chloride into chlorine gas, aqueous sodium hydroxide and hydrogen gas. For example, in FIG. 5 the portion 40 of the catholyte chamber 38 for the cathode 10 of FIG. 3 for cell 63 would be the anode backboard 14 (FIG. 1) of cell 64 (FIG. 5). Referring to FIG. 3, there are electrical connections between partition means 40 and cathode backplate 16 to allow the cell series (FIG. 5) to be a continuous series, low voltage electrical circuit. These connections are not shown here, however, as they are well known to those skilled in the art, are not part of the invention, and whose presence in the drawing would tend to obscure the essential features of the invention.

As electrical current is applied to a cell, sodium ions are transported from the anolyte surrounding anodes 12 through the ion exchange membrane 24 to the cathode pocket 10. At working faces 30 and 31 of pocket 10 hydrogen gas is evolved from electrolysis of the water in the catholyte and the transported sodium ions form aqueous sodium hydroxide with the hydroxyl ions freed from the electrolyzed water. The newly formed hydrogen gas rises within the cathode pocket 10, and as it does so it has a gas lifting effect upon the liquid catholyte within the cathode 10. This gas lifting effect would carry too much of the liquid catholyte out of the cell with it under normal cell operating conditions unless means were provided to re-circulate the liquid catholyte back into the bottom of the cathode 10.

This gas lifting action can be used to advantage by having it circulate the catholyte so that a uniform concentration of aqueous sodium hydroxide tends to be maintained throughout the interior of cathode pocket 10. Such uniformity of sodium hydroxide concentration is desirable to insure uniform operation of the membrane.

Another problem to be reckoned with in chlorine cell operation is the build up of gas in the tops of the electrodes. Gas is essentially an electrical non-conductor. Hence the more gas in the catholyte around the working faces of an electrode, the greater will be the electrical resistivity around those working faces, and hence the greater will be the electrical power consumption and voltage required to operate the cell per unit of hydrogen and sodium hydroxide product. Such excess power consumption and higher voltage is, of course, desired to be minimuzed as it represents wasted energy and higher operating cost.

By proper combinations of width of cathode 10, number and location of baffles 32 in cathode 10, and size, number and location of catholyte circulation portholes 36 in backbar 26, the operating power (voltage) can be significantly reduced.

The following examples will demonstrate this voltage reduction.

EXAMPLE I

Figure 6:
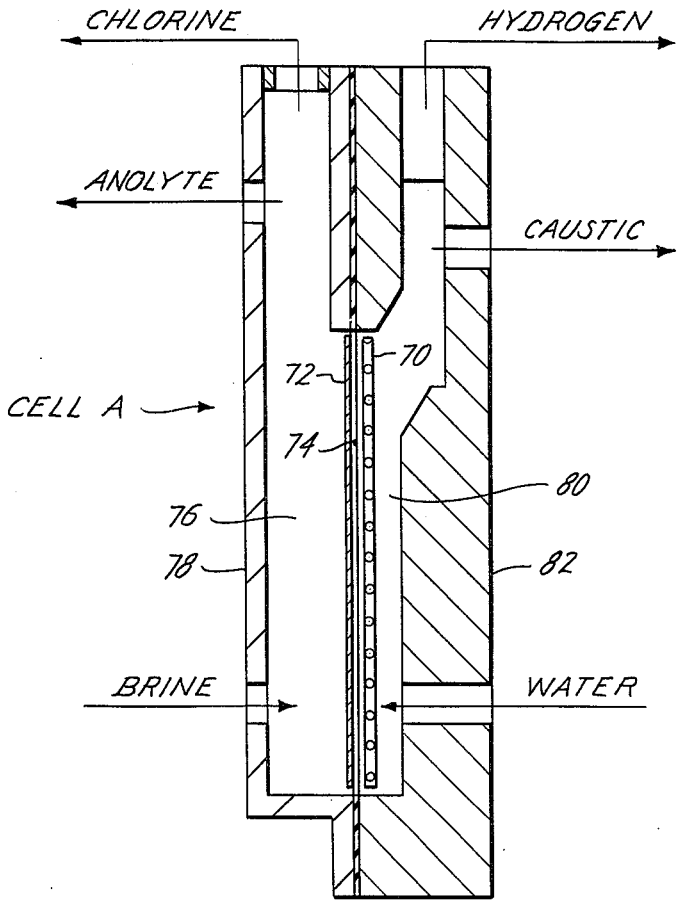
FIG. 6 is a cross-sectional end view of a laboratory mini-cell against which the performance of various pocket cells in the examples could be measured.

To establish a base line voltage curve against which to compare the voltage performances of the new vertical pocket membrane type cathode in a cell, voltage data was collected from a laboratory mini-cell run at varying current densities. FIG. 6 gives a sectional diagrammatic side view of this mini-cell which will be referred to by reference letter A. Only one cathode 70 and one anode 72 were used in mini-cell A, cathode 70 and anode 72 were perforated flat plates, parallel to one another, vertically oriented, and spaced a small but discrete distance apart. In the space between them was stretched a Nafion® 324 ion exchange membrane 74. The anolyte section 76 was formed by a rectangular frame 78 made of titanium metal. Frame 78 had appropriate openings for the inlet of brine and the escape of gaseous chlorine and liquid anolyte. The catholyte section 80 of mini-cell A is formed by a frame 82 made of acrylic plastic. Catholyte section 80 had suitable openings for the entrance of make-up water and the exit of gaseous hydrogen and liquid caustic. Note that outlet for hydrogen gas came straight out of the top of catholyte section 80 as opposed to the tortuous path of the cathode pocket 10 of the present invention wherein the hydrogen gas had to first pass horizontally through openings 36 and 22 before it could rise vertically through catholyte chamber 38 (FIG. 3) and out of the cell through openings 78 (FIG. 5). This tortuous path is necessary, however, in commercial cells where many anodes 12 and cathodes 10 are interleaved together (FIG. 1) in one cell and the top region of that cell is used for allowing chlorine to escape.

Recognizing there was a problem in converting the vertical opening for hydrogen escape in mini-cell A to horizontal openings 36, 22 in the back side of pocket cells when high current density ion exchange membranes 10 are substituted for the older asbestos type diaphragms was one of the stumbling blocks in making this invention. The cathode assembly 10 devised to solve this problem is the essence of this invention.

Figure 7:
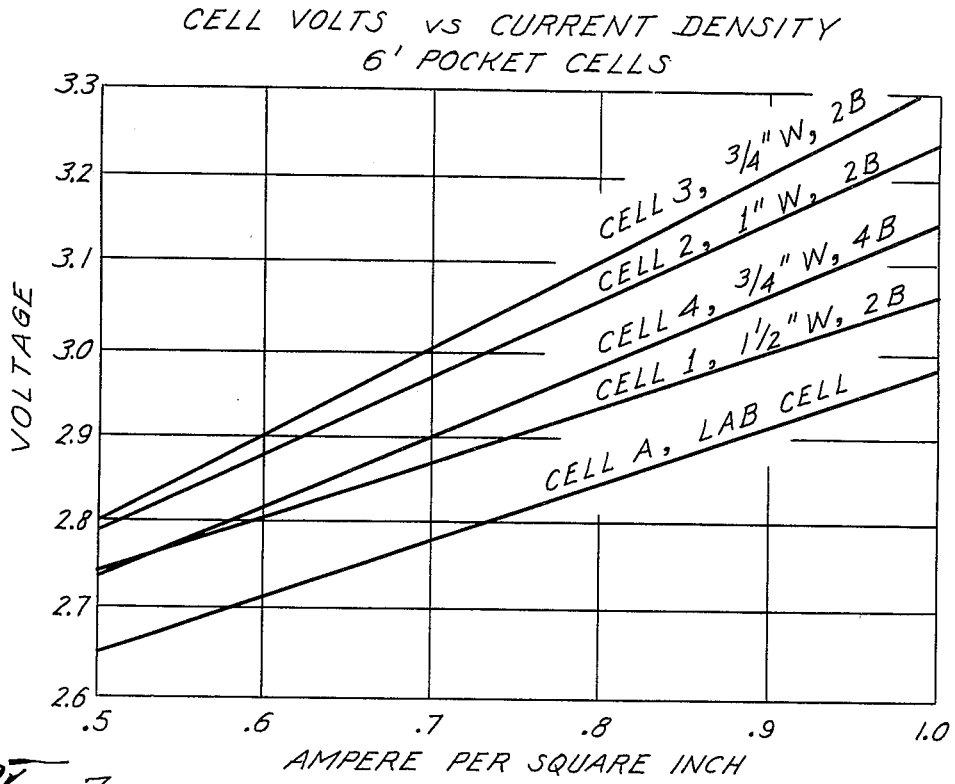
FIG. 7 is a graph showing the different operational voltages plotted against varying current densities for the different cells used in Examples I and II below.

Insofar as is known to the inventors this lab mini-cell operates at optimum voltage and thus represents the best results achievable regardless of design, etc. The lab cell used in this study had an electrode area of 27.6 square inches. Cell compartments were constructed of titanium and acrylic plastic. Each of these compartments had appropriate inlet and outlet ports for introducing saturated brine and water to the anolyte side and catholyte side respectively, for removing catholyte from the catholyte chamber, and for removing hydrogen and/or chlorine gases. The cells were assembled with $RuO_2$-$TiO_2$ coated, expanded metal anodes and woven wire, steel cathodes. Garlock and Teflon gaskets were used to seal the membrane and cell compartments. Electrode spacing was maintained at three millimeters. A single glass immersion heater inserted into the anolyte was used to maintain cell temperature. A schematic of the cell is shown in FIG. 7. The membrane (Nafion® 324) was pretreated in 80° C. water for one hour before placing in the cell. Cell startup was preceded by filling the anolyte compartment with saturated brine (NaCl) and the catholyte compartment with ~12 wt.% NaOH. Brine was fed to the cell at a flow rate to maintain approximately 12 wt.% NaOH in the catholyte overflow. Cell temperature was maintained at 80°±2°

C. with less than two degrees difference in anolyte and catholyte temperatures. The cell was operated with approximately equal electrolyte levels. The applied current was varied during operation and the cell voltage recorded.

Figure 8:
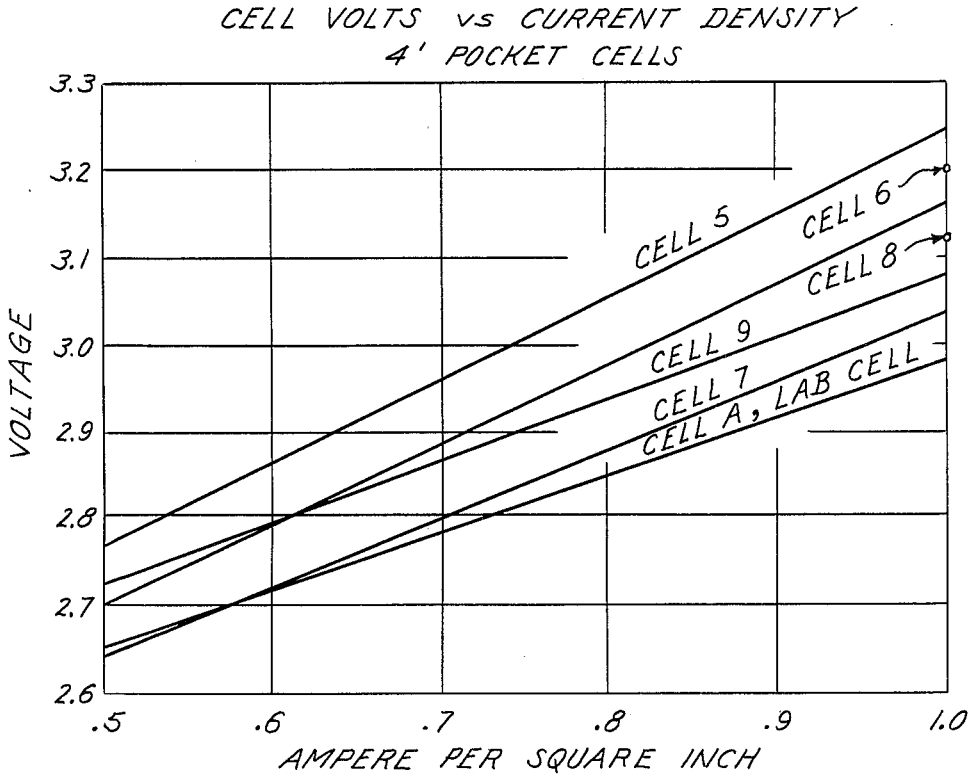
FIG. 8 is a graph showing the different operational voltages plotted against varying current densities for the different cells used in Examples I and III below.

The voltage at given current densities for this lab cell is given in Table 1 below and is plotted as the curve labelled "A" on the graph in FIGS. 7 and 8.

TABLE I

| CURRENT DENSITY (amperes/square inch) | CELL VOLTAGE (volts) |
|---|---|
| 0.5 | 2.65 |
| 0.7 | 2.78 |
| 0.9 | 2.92 |
| 1.0 | 2.98 |

To demonstrate the effect of cathode pocket width and the presence of baffles upon cell voltage in pocket cells, the following example was run.

EXAMPLE II

Four intermediate size chlorine cells were constructed. Each cell contained anode fingers and cathode pockets that were six feet high and 11 inches deep. Each cell contained five anode fingers and four cathode pockets in order to have an anode surface facing each cathode surface. The anodes were bolted to a solid sheet backboard containing holes to match protruding studs from the individual anode fingers. The anodes were made from expanded titanium metal by bending to form a hollow finger one inch thick and coating with oxides of titanium and ruthenium or cobalt oxides alone. The back of each anode finger was flat, ¼ inch titanium bar stock to which studs were welded protruding opposite to the anode finger direction. The cathodes were made from 6 gauge woven steel wire by bending a sheet to form the desired thickness and welding the top and bottom. The height wise edge was closed by welding onto the wire edges a flat piece of steel bar stock (the back bar) having the same width and height dimensions as the wire pocket. The steel bar had appropriate porthole openings for releasing cathodic products. For each cathode pocket, there was an opening located 1.625 inches below the top of the cathode and one hole located 1.625 inches above the bottom of the cathode. Thirteen other holes were located equally spaced along the backbar. Each pocket was open in the back the maximum amount allowable considering sealing area for the membrane and cross-section area of the studs. The percent of open area is given in Table II. In areas that were not open, studs were attached by welding, protruding opposite to the direction of the wire pocket. The cathode pockets were bolted, by means of the studs, to a solid backplate with appropriate portholes to accept the studs and match the openings for cathodic product release in the cathode pockets. The cells were assembled by bolting the anode assembly and cathode assembly onto opposite open sides of a frame. The frame plus anode and cathode assemblies completed an elongated closed box. A cover was then bolted onto the box behind the cathode backscreen to form a catholyte compartment for cathodic products. Entry and exit ports were drilled into the cathode compartment to allow addition of water and overflow of caustic and hydrogen gas. Entry and exit ports were drilled into the cell frame to allow addition of a brine solution and overflow of depleted brine and chlorine gas. The cathode pockets were covered with an ion exchange membrane (Nafion ® 324, a product of E. I. duPont) by heat sealing techniques before assembly. The membrane divides the assembled cell into an anode compartment and a cathode compartment. The anodes and cathodes were mounted on their respective backboards and backplates such that the space between an anode surface and a cathode surface was 3/16 inches. Electrical energy was supplied to the cell by making electrical contact to copper sheets in contact with appropriate anode and cathode studs and extending externally to the cell. The four cells were different only as described below:

Cell 1: Each cathode pocket was 1.5 in. wide and contained two baffles, spaced 2 ft. from top and bottom and 2 ft. apart, at an angle of 45° rising to the backscreen.

Cell 2: Same as Cell 1 except the pocket was 1.0 in. wide.

Cell 3: Same as Cell 1 and 2 except the pocket was 0.75 in. wide.

Cell 4: Same as Cell 3 except there were four baffles located equal distance within the pocket.

Application of 5500 amps (1.0 amps/in.$^2$) to the circuit in which the above cells were in and feeding appropriate flows of brine to the anode compartment and water to the cathode compartment resulted in only voltage variations in cell performance. Current efficiency was essentially the same in all cells. The volume rate of hydrogen gas produced was about 160 cubic centimeters per second per cathode pocket. The following table shows the data after 11 days operation.

TABLE II

| Cell No. | No. of Baffles | Cell Width (inches) | % Porthole Area to Backbar Area | Cell Voltage (volts) |
|---|---|---|---|---|
| 1 | 2 | 1.5 | 49 | 3.12 |
| 2 | 2 | 1.0 | 38 | 3.30 |
| 3 | 2 | 0.75 | 25 | 3.32 |
| 4 | 4 | 0.75 | 25 | 3.19 |

Comparison of Cells 1, 2 and 3 shows the trend of increasing voltage with decreasing pocket width. The widest pocket being clearly superior. Comparing equal width cells 3 and 4 clearly demonstrates the benefit in reduced voltage obtained by increasing the number of baffles.

To demonstrate that the same relationships of voltage per cell remained the same over various current densities, in the above four cells, the current densities for each cell were varied and the cell voltage measured. The voltages and current densities data points are given in the following tables and plotted on the graph of FIG. 7. These plots are labelled 1, 2, 3, and 4 to correspond with their respective cell numbers.

TABLE III

| | Current Density (amps./in.$^2$) | Cell Voltage (volts) |
|---|---|---|
| Cell 1 | .39 | 2.643 |
| | .46 | 2.703 |
| | .54 | 2.770 |
| | .61 | 2.822 |
| | .77 | 2.951 |
| | .83 | 2.953 |
| | .908 | 3.016 |
| | .986 | 3.064 |
| Cell 2 | .39 | 2.692 |
| | .46 | 2.752 |
| | .54 | 2.827 |
| | .61 | 2.822 |
| | .77 | 3.060 |

TABLE III-continued

| | Current Density (amps./in.$^2$) | Cell Voltage (volts) |
|---|---|---|
| | .83 | 3.109 |
| | .908 | 3.165 |
| | .986 | 3.237 |
| Cell 3 | .39 | 2.701 |
| | .46 | 2.760 |
| | .54 | 2.844 |
| | .61 | 2.909 |
| | .77 | 3.052 |
| | .83 | 3.106 |
| | .908 | 3.192 |
| | .986 | 3.303 |
| Cell 4 | .39 | 2.645 |
| | .46 | 2.678 |
| | .54 | 2.768 |
| | .61 | 2.829 |
| | .77 | 2.965 |
| | .83 | 3.000 |
| | .908 | 3.063 |
| | .986 | 3.134 |

To demonstrate the effect upon cell voltage of the size of the portholes 36 and 22 and the use of baffles, the following experiment was conducted.

EXAMPLE III

Five cells were constructed similar to the cells of Example 2 except the height of the cathode pockets and anode fingers was 4 ft. rather than 6 ft., and each cathode pocket in all cells was 1.5 inches wide. The backplates had holes to match the holes in the back bar of the cathode pockets described below. Operation of the cells at 4000 amps (1.0 amps/in.$^2$) again resulted in only variations in cell voltage. Each cell produced hydrogen gas at a rate of about 466 cc/sec. A description of the cathode pockets for each cell and a table showing the operating data follows.

Cell 5: The cathode base had one, 1 inch diameter hole in the top and in the bottom of the backbar to provide for simple catholyte circulation. No baffles were used.

Cell 6: Same as Cell 5 except two 1 inch diameter holes were used in the top and in the bottom of each pocket.

Cell 7: Three, 1 in.×3 in. holes were used. One at the top, middle and bottom with a baffle extending down from the backbar at 45° and connected to the backbar at the top of the middle hole. The baffle extended 85% of the pocket depth.

Cell 8: Nine, 1 in.×3 in. holes were used. This resulted in 39% of the pocket backbar being open. No baffles were used.

Cell 9: Same as Cell 8 except two polypropylene baffles were used. These baffles were wedged between the faces of the cathode pocket and extended downwardly into the pocket at 30°. These baffles extended to the curvature made by the curved leading edges of the cathode which was about 93% of the pocket depth. These two baffles were welded equidistant along the backbar. That is, the top one was welded 1.3 ft. below the top of the 4 ft. backbar and the bottom one was welded 1.3 ft. from the bottom of the backbar thus leaving a 1.3 ft. section of backbar located between the two baffles.

The following data in Table IV demonstrates the reduction of cell voltage due to baffles and porthole size.

TABLE IV

| Cell Nos. | No. Of Baffles | Cell Width (inches) | % Porthole Area to Backbar Area | Cell Voltage (volts) |
|---|---|---|---|---|
| 5 | 0 | 1.5 | 2.3 | 3.26 |
| 6 | 0 | 1.5 | 4.6 | 3.21 |
| 7 | 1 | 1.5 | 13.0 | 3.04 |
| 8 | 0 | 1.5 | 39.1 | 3.12 |
| 9 | 2 | 1.5 | 39.1 | 3.08 |

Comparison of Cell 5 with Cell 6 and Cells 5 and 6 with Cells 7, 8 and 9 show the importance of having more open area in the backbar of the cathode pocket. The smaller differences between Cell 7, 8 and 9 may be attributable to differences in circulation of the catholyte once sufficient backbar open area is present. Cell 7 obviously has sufficient open area located in such a way as to obtain degassing at least equal to Cells 8 and 9 which have more open area. Even with three times the open area of Cell 7, addition of another baffle (Cell 9) did not result in performance superior to Cell 7. Comparing Cells 8 and 9 does show benefit from baffles.

To demonstrate that the same voltage advantages were retained in the above five cells while using different current densities, the current densities were varied for each cell and the voltages measured. These results are given below in Table V and are plotted in the graph of FIG. 8. The plots of the data from Cells 5, 6, 7, 8 & 9 are labelled 5, 6, 7, 8, & 9 respectively.

TABLE V

| | Current Density (amps./in.$^2$) | Cell Voltage (volts) |
|---|---|---|
| Cell 5 | .5 | 2.765 |
| | 1.0 | 3.25 |
| Cell 6 | .5 | No data |
| | 1.0 | 3.20 |
| Cell 7 | .5 | 2.64 |
| | 1.0 | 3.04 |
| Cell 8 | .5 | No data |
| | 1.0 | 3.122 |
| Cell 9 | .5 | 2.72 |
| | .75 | 2.91 |
| | 1.0 | 3.08 |

Examples I–III clearly show the voltage advantage gained by control of cathode pocket width, use of baffles in the pockets and control of circulation outlet area of vertical cathode membrane pockets in chlorine cells.

What is claimed is:

1. A cathode for use in an electrolytic cell comprising (1) a pair of foraminous plate-like members joined in parallel spaced-apart relationship on three sides to provide a pocket-like member;

(2) an end-member fixably matingly joinable with the open end of said pocket-like member;

(3) baffle members extending from said end-member into said pocket traversing from side to side and into from about 60 to about 98 percent of the distance opposite said end-member;

(4) portholes in and through said end-member, one at the upper end of said end-member and one at the lower end of said end-member and one below the point of attachment of each baffle from said end-member, said portholes providing fluid passage for from 5 to about 50 percent of the area of said end-member;

(5) means associated with said end-member to secure said end-member when integral with said pocket in electrical contact and fluid tight abutment to a catholyte backplate of said electrolytic cell; and (6) a non-porous ion-exchange membrane enclosing said foraminous plate-like members.

2. A metal pocket shaped cathode assemblage for use in electrolytic cells comprising:

(1) a pair of foraminous plate-like members joined in parallel relationship to each other by edge members of sufficient dimension to hold said plate-like members in spaced apart relation thereby forming said pocket there between;

(2) structural and electrically conductive stud-like means extending outwardly from one of said edge members for attaching said pocket to a cell cathode side backboard;

(3) said edge member also provided with at least three fluid communication means therethrough with at least one of said communicating means being at the top of said edge member, at least one of said communicating means being at the bottom of said edge member, and at least one of said communicating means being intermediate between the top and bottom communicating means; said edge member communicating means matingly engaging similar fluid communication means in said backboard;

(4) said edge member also being provided with at least one baffle member extending into the pocket interior, each baffle member being located above at least the central fluid communicating means and positioned in a downwardly angularly sloping direction from said edge member, said baffle extending for from about 60 to about 98 percent of the dimension of said pocket;

(5) said fluid communicating means comprising at least 5 percent of said edge member area; and (6) an ion-exchange membrane enclosing said pair of plate-like members.

3. A vertical cathode pocket assembly for use in a membrane type chlorine electrolysis cell which comprises:

a. two vertical, foraminous, spaced apart working faces which have their top, bottom and leading edges joined together;

b. a vertical backbar to which the back edges of the working faces are attached;

c. baffles attached to said backbar which slope downward from said backbar into the cathode pocket between the working faces at an angle of from about 5° to about 60° from the horizontal, which baffles extend into the pocket a distance of from about 60% to about 98% of the pocket depth and which baffles are sufficient in number so as to be spaced substantially equidistant along the backbar at intervals which are no greater than from about 1 foot to about 3 feet;

d. horizontal portholes through the vertical backbar, one being located at the top of the backbar, one at the bottom, and one directly beneath each baffle, the area of each porthole being substantially equal to the area of each of the other portholes, and the sum of the areas of all of the portholes being from about 5% to about 50% of the area of a vertical cross-section of the cathode pocket taken perpendicularly through the working faces;

e. an ion-exchange envelope fitted around the working faces and sealably attached to the backbar; and f. a vertical cathode backplate to which the vertical backbar is rigidly and sealably attached, said backplate having horizontal portholes which are aligned with the horizontal portholes in the backbar so as to form a fluid communications means between the interior of the working faces and a catholyte compartment on the side opposite the backplate from the backbar, said backplate portholes being no smaller in cross-sectional flowpath area than the backbar holes with which they are aligned.

4. The cathode pocket assembly of claim 3 wherein the working faces are spaced apart from one another a distance of at least an average of about 0.75 inches.

5. The cathode pocket assembly of claim 3 wherein the working faces are spaced apart at least about 1.0 inches.

6. The cathode pocket assembly of claim 3 wherein the working faces are spaced apart at least about 1.5 inches.

7. The cathode pocket assembly of claims 3, 4, 5 or 6 wherein the working faces are parallel.

8. The vertical cathode pocket assembly of claim 3 wherein the baffles extend into the assembly from the backbar to a depth of from about 90% to about 98% of the pocket depth, wherein the sum of the areas of the portholes is greater than about 5% of the vertical cross-section of the cathode pocket taken perpendicularly through the working faces, and wherein there are sufficient baffles spaced substantially equidistant along the backbar at intervals of about one foot.

9. The vertical cathode pocket assembly of claim 3 wherein the width of the assembly is about 1.5 inches, the height of the cathode is about 4 feet; wherein one baffle extends from about mid-height of the backbar into about 95% of the depth of the pocket interior; wherein there are three portholes, one at the top of the backbar, one at its bottom and one directly beneath the baffle, each of which portholes has a cross-sectional flowpath area of about 3 square inches; and wherein the working faces are parallel.

10. A cathode for an electrolytic cell comprising a pocket-shaped body which comprises a pair of parallel, vertical foraminous spaced apart metal plate-like members joined on three edges to each other to form therewith a pocket-like assembly, the fourth side of said pocket-like assemblage being a vertical backbar having studs or other connecting means for use in joining the cathode to an electrically charged backplate in such a cell; said fourth side having one or more downwardly angularly disposed baffle members attached thereto and extending therefrom into the interior of the pocket-shaped body; said backbar having at least one porthole near its top, at least one porthole near its bottom, and at least one porthole located directly beneath each baffle; a membrane envelope fitted around the cathode assembly; and a vertical cathode backplate to which the vertical backbar is rigidly and sealably attached, said backplate having horizontal portholes which are aligned with the horizontal portholes in the backbar so as to form a fluid communications means between the interior of the working faces and a catholyte compartment on the side opposite the backplate from the backbar, said backplate portholes being no smaller in cross-sectional flowpath area than the backbar holes with which they are aligned.

11. A foraminous metal cathode for use in an electrolytic cell, said cathode comprising:

a generally pocket-shaped cathode configuration comprising a pair of foraminous plate-like members which are parallel to each other except that three edges of one plate are joined in non-planar manner to the corresponding three edges of the other, leaving an unjoined edge on each which forms the elongated pocket opening;

a backbar attachable to the pocket to close off the opening, said backbar having at least three portholes along its length with at least one porthole being near the top of said backbar and with at least one porthole being near the bottom of said backbar, and said portholes comprising from about 5 to about 50 percent of the area of said backbar;

baffle members of elongate structure affixed to one surface of the backbar in a manner so as to extend into said cathode pocket when said backbar is attached thereto, each of said baffle members being located directly above a porthole;

a membrane envelope fitted around the cathode plate-like members; and a vertical cathode backplate to which the vertical backbar is rigidly and sealably attached, said backplate having horizontal portholes which are aligned with the horizontal portholes in the backbar so as to form a fluid communications means between the interior of the working faces and a catholyte compartment on the side opposite the backplate from the backbar, said backplate portholes being no smaller in cross-sectional flowpath area than the backbar holes with which they are aligned.

12. A cathode pocket assembly for use in an electrolytic chlor-alkali cell which comprises:

a vertical cathode pocket abutting and sealably attached to a vertical backplate of a cell catholyte chamber having fluid communication between the interior of the cathode pocket and a catholyte chamber through at least three openings through the backplate between the cathode pocket and catholyte chamber with at least one of these openings being near the bottom of the cathode pocket, at least one of these openings near the top of the cathode pocket, and at least one of these openings between the top and bottom of the cathode pocket, the sum of the area of said openings being greater than about 5% of the abutting area of the cathode pocket, at least one internal baffle extending from the backplate abutting side of the cathode and into the cathode plate at a downward slope of from about 5° to about 60° from the horizontal and extending into said pocket a distance of from about 60% to about 98% of the depth of said pocket, said baffles being located above at least one opening in said backplate side of said cathode pocket, said baffles and said openings cooperating to improve the circulation of catholyte in the pocket as well as to decrease the amount of hydrogen located in said pocket interior and cooperating to reduce gas blinding at the interior surfaces of an ion-exchange membrane disposed around the electrolytic working faces.

* * * * *

UNITED STATES PATENT AND TRADEMARK OFFICE

CERTIFICATE OF CORRECTION

PATENT NO. : 4,329,218

DATED : May 11, 1982

INVENTOR(S) : Marius W. Sorenson, Bobby R. Ezzell, and John R. Pimlott

It is certified that error appears in the above—identified patent and that said Letters Patent is hereby corrected as shown below:

Col. 3, line 37, remove one "the" from between wherein and vertical.

Col. 4, line 18, change "lyic" to --lytic--.

Col. 5, line 67, remove the period (.) after apart.

Col. 16, line 18, change "plate" to --pocket--.

Signed and Sealed this

*Twenty-first* Day of *September 1982*

[SEAL]

*Attest:*

GERALD J. MOSSINGHOFF

*Attesting Officer*

*Commissioner of Patents and Trademarks*